US009681786B2

(12) United States Patent
Mitchell et al.

(10) Patent No.: US 9,681,786 B2
(45) Date of Patent: Jun. 20, 2017

(54) VACUUM CLEANER

(71) Applicant: Dyson Technology Limited, Wiltshire (GB)

(72) Inventors: Joanne Katy Mitchell, Swindon (GB); Peter Graham Luetchford, Bristol (GB); Ketan Patel, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/843,421

(22) Filed: Sep. 2, 2015

(65) Prior Publication Data

US 2016/0058259 A1 Mar. 3, 2016

(30) Foreign Application Priority Data

Sep. 3, 2014 (GB) ..... 1415610.3

(51) Int. Cl.
*A47L 9/16* (2006.01)

(52) U.S. Cl.
CPC ..... *A47L 9/1683* (2013.01); *A47L 9/1608* (2013.01); *A47L 9/1633* (2013.01); *A47L 2201/00* (2013.01)

(58) Field of Classification Search
CPC ... A47L 9/1683; A47L 9/1608; A47L 2201/00
See application file for complete search history.

(56) References Cited

U.S. PATENT DOCUMENTS

| | | | | |
|---|---|---|---|---|
| 6,553,612 | B1 * | 4/2003 | Dyson | A47L 5/28 15/319 |
| 7,770,256 | B1 | 8/2010 | Fester | |
| 2004/0154126 | A1 * | 8/2004 | Hansen | A47L 9/1666 15/353 |
| 2007/0084158 | A1 * | 4/2007 | Fester | A47L 9/127 55/337 |
| 2008/0086836 | A1 * | 4/2008 | Carr | A47L 9/1683 15/353 |

(Continued)

FOREIGN PATENT DOCUMENTS

| | | |
|---|---|---|
| EP | 2413767 | 2/2012 |
| EP | 2674087 | 12/2013 |
| EP | 2764810 | 8/2014 |

(Continued)

OTHER PUBLICATIONS

Combined Search and Examination Report dated Mar. 3, 2015 directed towards GB Application No. 1415610.3; 2 pages.

(Continued)

*Primary Examiner* — Dung Van Nguyen
(74) *Attorney, Agent, or Firm* — Morrison & Foerster LLP

(57) ABSTRACT

A vacuum cleaner comprising a main body and a cyclonic separating apparatus. The separating apparatus comprises a dirt collection chamber and a baffle arrangement, and is mounted within the main body such that a first part of the dirt collection chamber is obscured and a second part of the dirt collection chamber is visible during normal use. The baffle arrangement is positioned within the dirt collection chamber such that, during use, an airflow moving within the dirt collection chamber is disrupted by the baffle arrangement causing dirt to collect preferentially in the second part.

9 Claims, 3 Drawing Sheets

(56) References Cited

U.S. PATENT DOCUMENTS

| | | | | |
|---|---|---|---|---|
| 2013/0305483 | A1 | 11/2013 | Dyson et al. | |
| 2013/0305484 | A1* | 11/2013 | Dyson ..... | A47L 9/009<br>15/353 |

FOREIGN PATENT DOCUMENTS

| | | |
|---|---|---|
| GB | 2344778 | 6/2000 |
| GB | 2422095 | 7/2006 |
| GB | 2441300 | 3/2008 |
| GB | 2502132 | 11/2013 |
| JP | 2006-81946 | 3/2006 |
| JP | 2013-240598 | 12/2013 |

OTHER PUBLICATIONS

International Search Report and Written Opinion mailed Oct. 13, 2015 directed towards International Application No. PCT/GB2015/052321; 10 pages.

* cited by examiner

VACUUM CLEANER

REFERENCE TO RELATED APPLICATIONS

This application claims priority of United Kingdom Application No. 1415610.3, filed on Sep. 3, 2014, the entire contents of which are incorporated herein by reference.

FIELD OF THE INVENTION

The present invention relates to a vacuum cleaner comprising a cyclonic separation apparatus having a baffle arrangement that encourages dirt to collect in a preferential part.

BACKGROUND OF THE INVENTION

Vacuum cleaners that utilise cyclonic separation apparatus are well known. EP2413767, EP2674087 and EP 2764810 each describe vacuum cleaning apparatus that utilise cyclone separation techniques.

In general, cyclonic separation apparatus functions by admitting a dirty airflow into a cyclone chamber via a tangential inlet which causes the airflow to follow a spiral or helical path within the cyclone chamber. This causes the dirt and debris contained within the airflow to separate, allowing the dirt to be collected and removed. Generally, the separated dirt and debris collects in a dirt collection chamber located beneath the cyclone chamber. The dirt collection chamber may be transparent so that the user is able to view the amount of dirt and debris that has been collected. The user is then able to determine when it is necessary to empty the dirt collection chamber.

The dirt collection chamber may not be entirely visible to the user, particularly during normal use. For example, the cyclonic separation apparatus may be mounted within a main body of the vacuum cleaner such that part of the dirt collection chamber is obscured from view during normal use. A problem may then arise should dirt collect only in that part obscured from view. In particular, the user would continue to use the vacuum cleaner causing the dirt collection chamber to become over-filled, resulting in a reduced efficiency of the cyclone. Additionally dirt may be re-entrained into the clean air outflow.

SUMMARY OF THE INVENTION

The present invention provides a vacuum cleaner comprising a main body and a cyclonic separating apparatus, the separating apparatus comprising a dirt collection chamber and a baffle arrangement, wherein the separating apparatus is mounted within the main body such that a first part of the dirt collection chamber is obscured and a second part of the dirt collection chamber is visible, and the baffle arrangement is positioned within the dirt collection chamber such that, during use, an airflow moving within the dirt collection chamber is disrupted by the baffle arrangement causing dirt to collect preferentially in the second part.

The baffle arrangement causes dirt and debris to collect unevenly in the dirt collection chamber. In particular, the baffle arrangement causes dirt and debris to collect preferentially in a part of the dirt collection chamber that is visible during normal use. The user is thus better able to observe the amount of dirt and debris that has collected in the dirt collection chamber.

A drawback with using such a baffle arrangement is that it reduces the overall capacity of the dirt collection chamber.

That is to say that the total possible amount of dirt and debris is reduced due to the fact that the dirt and debris will collect preferentially in a particular part of the dirt collection chamber and not throughout the dirt collection chamber. However, this drawback is offset by the advantage that the user is able to readily determine when the dirt collection chamber requires emptying as the dirt and debris collects in a part that is not obscured by the main body of the vacuum cleaner.

The dirt collection chamber may be cylindrical in shape and may be bounded by an outer wall and a base, and the baffle arrangement may comprise a plurality of baffles, with each baffle extending radially along the base.

Each baffle may extend along either the whole available radius of the base or a section or length of the radius. Since the baffles extend radially, the baffles are positioned perpendicular to the tangential direction of the cyclonic airflow. Each baffle is therefore configured such that the greatest possible surface area is exposed to airflow, thereby causing the maximum disruption to the airflow.

Each of the baffles may be planar in shape and extend vertically upwards from the base of the dirt collection chamber. The baffles may be connected to the base in order to prevent dirt and debris passing underneath the baffles. The baffles may also be connected to one wall or both of the walls bounding the dirt collection chamber. As a result, the baffles are better supported.

The baffles may be positioned such that the airflow moving around the dirt collection chamber is caused to follow a sinuous path through the baffle arrangement. As the air turns, the inertia of the dirt causes the dirt to collide with a baffle and settle in the area of the dirt collection chamber occupied by the baffle arrangement.

The separating apparatus may comprise two stages of separation: a first stage and a second stage. The two stages are connected in series such that the second stage located downstream of the first stage. The dirt collection chamber may then form part of the first stage, and the second stage may further comprise a further dirt collection chamber that is surrounded by the dirt collection chamber. Larger dirt and debris may be separated by the first stage and collected from the airflow in the dirt collection chamber whilst smaller dirt and debris may be separated by the second stage and collected in a further dirt collection chamber. An advantage of having two stages of separation is that the airflow that exits the vacuum cleaner is cleaner. The first stage of separation is intended to remove larger particles of dirt and debris. These particles are generally easier to separate from the airflow and so can be collected more effectively by a baffle arrangement. Another advantage arising from a first stage focused on removing larger particle of dirt and debris is that larger particles can be easily spotted by the user as they collect in the preferential part of the dirt collection chamber. Therefore the user is more aware of when the dirt collection chamber requires emptying.

It is also advantageous for the dirt collection chamber to surround the further dirt collection chamber so that a compact size for the cyclonic separation apparatus can be achieved. However, a part of the dirt collection chamber may be obscured by an inner wall forming the bounds of the further dirt collection chamber. The baffle arrangement is configured such that the dirt and debris is collected in the part which is not obscured by the further dirt collection chamber.

The dirt collection chamber may be cylindrical and may be bounded by an inner wall, an outer wall and a base, the further dirt collection chamber may be bounded by the base and the inner wall, the baffle arrangement may comprise a plurality of baffles, and each baffle may extend radially between the inner and outer walls of the dirt collection chamber. Each of the baffles may partly or fully extend radially between the inner and outer walls of the dirt collection chamber.

An advantage of using a cylindrical shape for the dirt collection chamber is that the further dirt collection chamber can be easily surrounded by including an inner wall within the dirt collection chamber. This inner wall also provides a circular boundary for the dirt collection chamber and baffles may still extend radially across the base of the dirt collection chamber so as to provide a perpendicular wall against the tangential direction of the cyclonic airflow. In addition, a compact size for the cyclonic separation apparatus can be readily achieved.

The dirt collection chamber may be cylindrical, the baffle arrangement may be located in a sector of the dirt collection chamber, and the sector may span an angle of between 90o and 140o. This particular spanning angle is advantageous because this angle provides a cyclonic separation apparatus that can be readily mounted into the main body of a vacuum cleaner of any size whilst also providing a wide enough perspective for the user to view the collected dirt and debris in the preferential part of the dirt collection chamber.

The baffle arrangement may comprise from three to six baffles in total. Any number of baffles within this range may be incorporated into the baffles arrangement, i.e. three, four, five or six. The number of baffles is limited by the efficiency of the baffle arrangement to preferentially collect dirt and debris. In addition, the baffles must be located within the sector of the base that houses the baffle arrangement. Thus, it is apparent that there is a spatial limitation on the total number of baffles that can be placed within this sector. Thus, there is a diminishing return on separation and dirt-collecting efficiency proportional to the number of baffles that make up the baffle arrangement.

The dirt collection chamber may be cylindrical and the baffle arrangement may comprise three baffles that are positioned such that the first and third baffles span a sector with an angle of between about 90o and 140o, and the second baffle may be positioned between the first and third baffles. This particular baffle arrangement provides a good disturbance to the airflow as well as providing enough of an area for the dirt and debris to gather. Additionally the cyclonic airflow is not overly disturbed by the baffle arrangement.

The vacuum cleaner may be one which is manoeuvred by a user, such as an upright or canister cleaner. Alternatively, the vacuum cleaner may function autonomously. An example of such a cleaner would include a domestic robotic cleaner. Domestic robot cleaners are required to have a low profile in order to clean under furniture. A user looking down on the domestic robotic cleaner may only be able to see the second part of the dirt collection chamber. It is therefore advantageous for the user to be able to easily assess the level of dirt and debris that has been collected by the robotic cleaner without having to disturb or lift the cleaner during use. The baffle arrangement allows for dirt and debris to preferentially collect in that part of the dirt collection chamber that is visible to a standing user.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
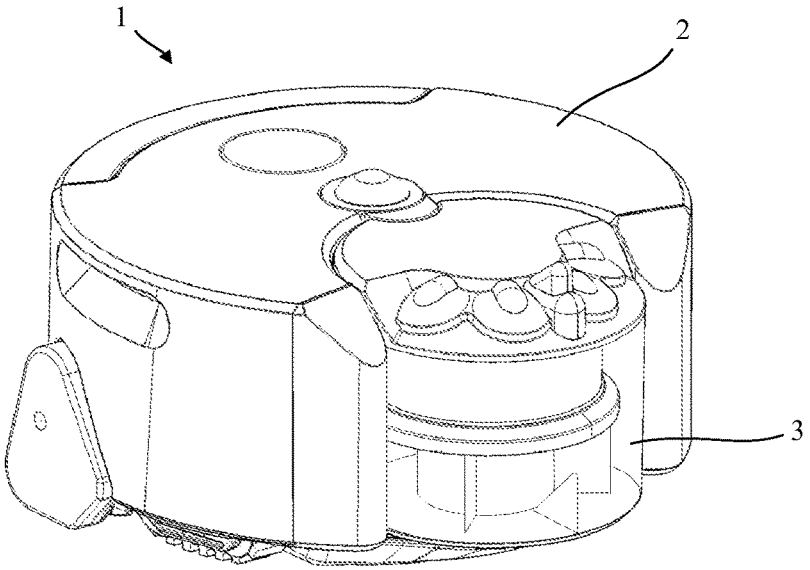
FIG. 1 is a perspective view of a vacuum cleaner.

FIG. 1 shows a vacuum cleaner 1 comprising a main body 2 and a cyclonic separation apparatus 3 removably mounted on the main body 2. The vacuum cleaner 1 is an autonomous or robotic cleaner and thus has a relatively low profile in order that the vacuum cleaner 1 can clean beneath furniture. More particularly, the main body 2 and the cyclonic separation apparatus 3 form a low profile cylinder, in which the diameter of the cylinder is greater than the height.

Figure 2:
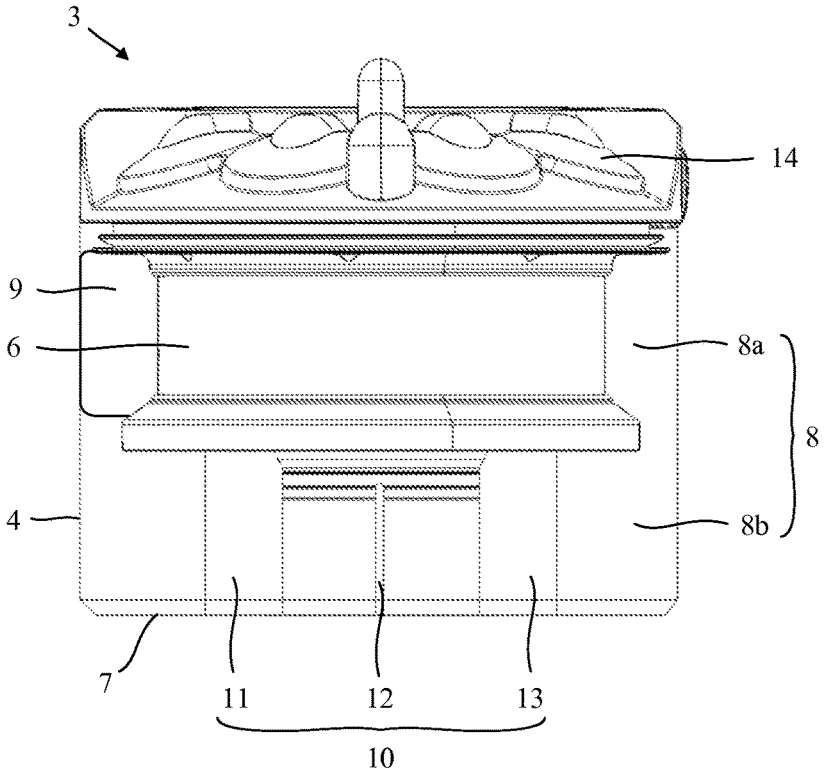
FIG. 2 is a front view of a cyclonic separation apparatus forming part of the vacuum cleaner.
Figure 3:
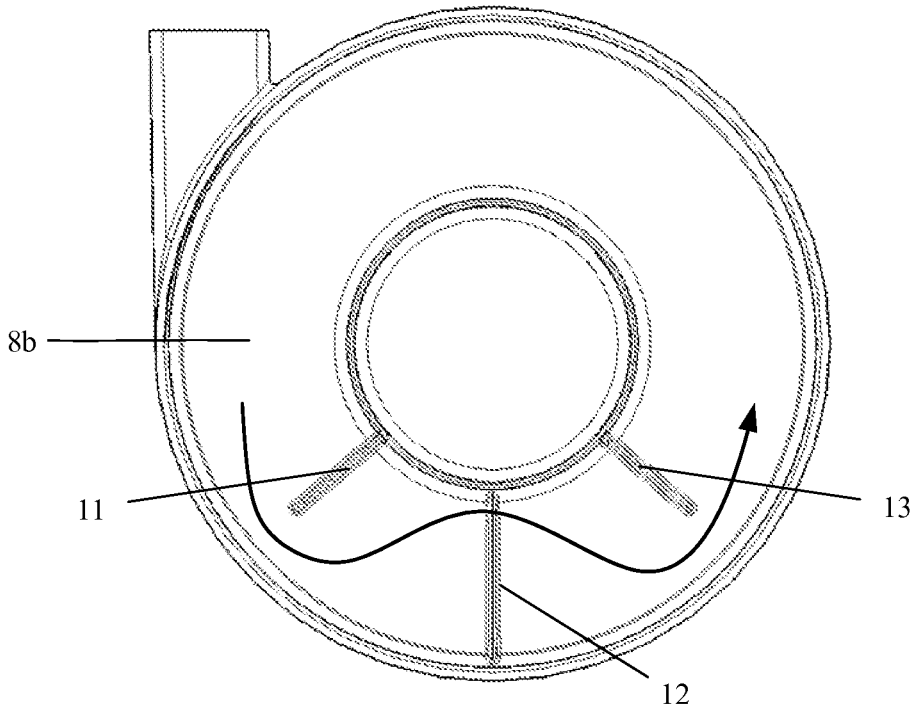
FIG. 3 is a plan view of a dirt collection chamber of the cyclonic separation apparatus.
Figure 4:
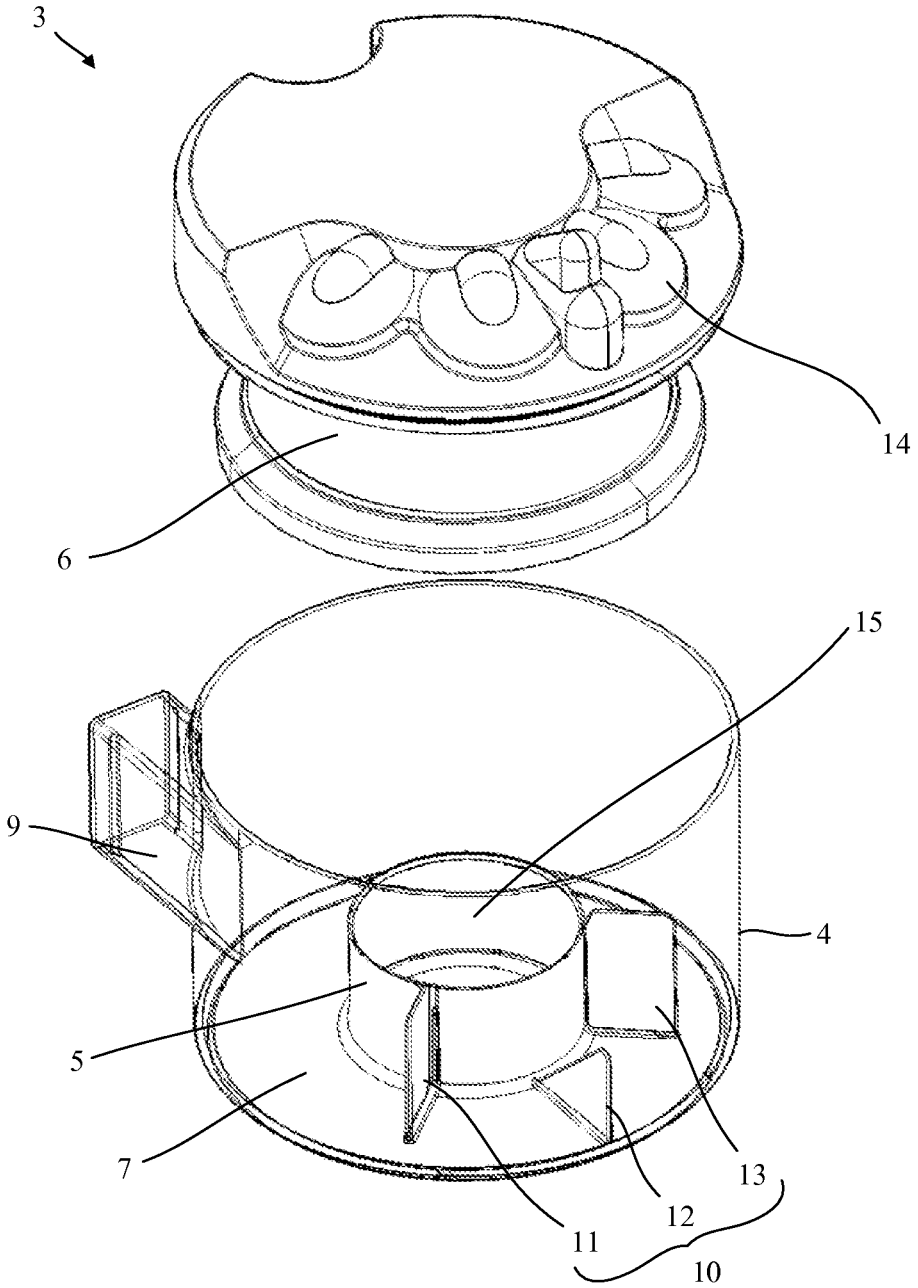
FIG. 4 is an exploded perspective view of the cyclonic separation apparatus.

The cyclonic separation apparatus 3 is shown in more detail in FIGS. 2 to 4. The cyclonic separation apparatus 3 comprises a first cyclone stage and a second cyclone stage located downstream of the first cyclone stage.

The first cyclone stage comprises an outer wall 4, an inner wall 5, a shroud 6 located between the outer and inner walls 4, 5, and a base 7. The outer wall 4, inner wall 5, the shroud 6 and the base 7 collectively define a chamber 8. The upper part of this chamber (i.e. that part generally defined between the outer wall 4 and the shroud 6) defines a cyclone chamber 8*a*, whilst the lower part of the chamber (i.e. that part generally defined between the outer wall 4, inner wall 5 and base 7) defines a dirt collection chamber 8*b*. The first cyclone stage therefore comprises a cyclone chamber 8*a* and a dirt collection chamber 8*b* located below the cyclone chamber 8*a*. The outer wall 4 comprises a tangential inlet 9 through which dirty air enters the cyclone chamber 8*a*, and the shroud 6 comprises perforations or a mesh through which cleansed air exits the cyclone chamber 8*a*.

The first cyclone stage comprises a baffle arrangement 10 positioned within the dirt collection chamber 8*b*. The baffle arrangement 10 comprises three baffles 11,12,13 that are spaced annularly around a sector of the dirt collection chamber 8*b*, the sector having an angle of about 1200. Each of the baffles 11,12,13 is planar and extends radially along the base 7 between the inner wall 5 and the outer wall 4. The first and third baffles 11,13 extend from the inner wall 5 and stop short of the outer wall 4. The second baffle 12 is positioned between the first and third baffles 11,13 and stops short of both the inner wall 5 and the outer wall 4. The first and third baffles 11, 13 are rectangular in shape, whilst the second baffle 12 is triangular. Additionally, the first and third baffles 11,13 are taller than the second baffle 12, whilst the second baffle 12 is longer. The reasons for this particular configuration are explained below.

The second cyclone stage comprises a plurality of cyclone separators 14 and a further dirt collection chamber 15. Each cyclone separator 14 is frusto-conical in shape and comprises an inlet, a dirt outlet and an air outlet. Dirt separated by each cyclone separator exits through the dirt outlet whilst the cleansed air exits through the air outlet. The dirt discharged by the cyclone separators collects in the further dirt collection chamber 15, which is defined by the interior space bounded by the inner wall 5 of the first cyclone stage.

During use, dirty air is drawn into the cyclone chamber 8*a* of the first stage via the inlet 9. The air spirals about the cyclone chamber 8*a* causing coarse dirt to be separated from the air. The coarse dirt collects in the dirt collection chamber

8*b*, and the partially cleansed air is drawn through the shroud 6 and into the second cyclone stage. The partially cleansed air then divides and is drawn into the cyclone separators 14, which act to separate fine dirt from the air. The fine dirt is discharged through the dirt outlet and collects in the further dirt collection chamber, whilst the cleansed air is drawn through the air outlet.

The vacuum cleaner 1 is an autonomous cleaner have a relatively low profile. Consequently, when a user stands over the vacuum cleaner 1, only a front part of the dirt collection chamber 8*b* is visible; this is perhaps best appreciated from FIG. 1. The rear part of the dirt collection chamber 8*b* is obscured from view by the main body 2, at least when a user stands over the vacuum cleaner 1. The first stage of the cyclonic separation apparatus 3 is responsible for separating relatively coarse dirt from the air. Rather than collecting evenly around the dirt collection chamber 8*b*, certain types of dirt can potentially bridge the gap between the inner and outer walls 4,5. The dirt would then become trapped and acts as a barrier for further dirt circulating around the dirt collection chamber 8*b*. Dirt would then collect and build up at this point. If dirt were to collect at the rear part of the dirt collection chamber 8*b*, the user would not be aware of the amount of dirt and debris that had collected in dirt collection chamber 8*b*. The user is therefore likely to continue using the vacuum cleaner 1, causing the dirt collection chamber to over-fill at the rear. The dirt would then begin to interfere adversely with the spiralling air within the cyclone chamber 8*a*, resulting in a reduced separation efficiency. Additionally dirt within the dirt collection chamber 8*b* may become re-entrained in the cleansed air. It is for this reason that the separation apparatus 3 comprises a baffle arrangement 10. As will now be explained, the baffle arrangement 10 encourages dirt to collect preferentially at the front part of the dirt collection chamber 8*b*. As a result, a user is better alerted to the fact that the dirt collection chamber is full and requires emptying.

The baffle arrangement 10 is positioned within the front part of the dirt collection chamber 8*b*, i.e. that part which is visible to a user when standing over the vacuum cleaner 1 during normal use. During use, there is an airflow that moves around the dirt collection chamber 10. The baffle arrangement 10 disturbs and slows the airflow travelling around the dirt collection chamber 8*b* such that any dirt which has settled in the dirt collection chamber 8*a* is not swept around the chamber 8*b* and into the rear part of the dirt collection chamber 8. In addition, the baffles 11,12,13 are shaped to trap dirt as it passes around the dirt collection chamber 8*b*.

The lengths, shapes and positions of the baffles 11,12,13 are configured such that the circulating airflow passing through the baffle arrangement 10 is caused to follow a sinuous path, as illustrated in FIG. 3. As the air turns, the inertia of the dirt causes the dirt to collide with a baffle and settle in the sector of the dirt collection chamber 8*b* occupied by the baffle arrangement 10. As a result, dirt collects preferentially in the front part of the dirt collection chamber 8*b*.

The baffle arrangement 10 comprises baffles of different heights and length. The first and third baffles 11, 13 are rectangular in shape, extend radially from the inner wall, and extend vertically from the base 7 to just beneath the shroud 6. The bottom of the shroud 6 is not level but instead comprises a skirt that flares outward. The length and height of the first and third baffles 11,13 are then chosen such that the baffles 11,13 sit beneath the skirt of the shroud 6. The second baffle 12 is triangular in shape with the highest point being closer to the outer wall 4. Unlike the first and third baffles 11,13, which are formed integrally with the inner wall 5, the second baffle 12 is not formed integrally with the outer wall 4. If the second baffle 12 were shorter in length and rectangular in shape, the baffle 12 would be poorly supported and may bend and break under the force of the circulating airflow or the dirt carried therewith. The second baffle 12 is therefore longer than the first and third baffles 11,13 such that the baffle 12 is better supported by the base 7. The shape of the second baffle 12 is then triangular such that a path is provided between the baffles for the circulating air passing through the baffle arrangement 10. The second baffle 12 is shorter in height than the first and third baffles 11,13. Whilst the first and third baffles 11,13 sit wholly beneath the shroud 6, the second baffle 12 extends across the shroud 6. If the second baffle 12 were the same height as the first and third baffles 11,13, the baffle 12 would contact the bottom of the shroud 6 and create a blockage that would interfere adversely with the spiralling air in the cyclone chamber 8*a*. The second baffle 12 is therefore shorter in height so as to create a clearance between the baffle 12 and the bottom of the shroud 6.

The provision of baffles in the dirt collection chamber of a cyclonic separation apparatus is known. The baffles are again used to disrupt the circulating air at the bottom of the dirt collection chamber. However, the baffles are spaced evenly around the dirt collection chamber. The intention of the baffles is then to prevent dirt from being re-entrained in the spiralling air. The baffles are not intended, and indeed do not, encourage dirt to collect in a preferential part of the dirt collection chamber. Indeed, to do so would seem counter-intuitive since it would reduce the overall capacity of the dirt collection chamber. That is to say that the total amount of dirt that can be collected by the dirt collection chamber before it requires emptying will be reduced. However, where the cyclone separation apparatus is partly obscured, this drawback is offset by the advantage that the user is able to readily identify when the dirt collection chamber requires emptying.

The invention claimed is:

1. A vacuum cleaner comprising a main body and a cyclonic separating apparatus, the separating apparatus comprising a dirt collection chamber and a baffle arrangement, wherein the separating apparatus is mounted within the main body such that a first part of the dirt collection chamber is obscured and a second part of the dirt collection chamber is visible, and the baffle arrangement is positioned within the dirt collection chamber such that, during use, an airflow moving within the dirt collection chamber is disrupted by the baffle arrangement causing dirt to collect preferentially in the second part.

2. The vacuum cleaner of claim 1, wherein the dirt collection chamber is cylindrical and is bounded by an outer wall and a base, the baffle arrangement comprises a plurality of baffles, and each baffle extends radially along the base.

3. The vacuum cleaner of claim 2, wherein the baffles are positioned such that the airflow moving around the dirt collection chamber is caused to follow a sinuous path through the baffle arrangement.

4. The vacuum cleaner of claim 1, wherein the separating apparatus comprises a first stage and a second stage, the second stage is located downstream from the first stage, the first stage comprises the dirt collection chamber, the second stage comprises a further dirt collection chamber, and the dirt collection chamber surrounds the further dirt collection chamber.

5. The vacuum cleaner of claim 4, wherein the dirt collection chamber is cylindrical and is bounded by an inner wall, an outer wall and a base, the further dirt collection chamber is bounded by the base and the inner wall, the baffle arrangement comprises a plurality of baffles, and each baffle extends radially between the inner and outer walls of the dirt collection chamber.

6. The vacuum cleaner of claim 1, wherein the dirt collection chamber is cylindrical, the baffle arrangement is located in a sector of the dirt collection chamber, and the sector spans an angle of between 90° and 140°.

7. The vacuum cleaner of claim 1, wherein the baffle arrangement comprises between three and six baffles.

8. The vacuum cleaner of claim 1, wherein the dirt collection chamber is cylindrical, the baffle arrangement comprises three baffles, the first and third baffles span an angle of between 90° and 140°, and the second baffle is positioned between the first and third baffles.

9. The vacuum cleaner of claim 1, wherein the vacuum cleaner is a robotic vacuum cleaner.

* * * * *